US005724888A

United States Patent [19]

Okuda et al.

[11] Patent Number: 5,724,888

[45] Date of Patent: *Mar. 10, 1998

[54] PRINTED IMAGE AFTER-PROCESSING APPARATUS

[75] Inventors: Sadanao Okuda; Takahito Tojima; Takashi Isozaki, all of Tokyo, Japan

[73] Assignee: Riso Kagaku Corporation, Tokyo, Japan

[ * ] Notice: The term of this patent shall not extend beyond the expiration date of Pat. No. 5,476,034.

[21] Appl. No.: 548,550

[22] Filed: Oct. 26, 1995

[30] Foreign Application Priority Data

Nov. 2, 1994 [JP] Japan ..... 6-269828

[51] Int. Cl.[6] ..... B41L 13/04

[52] U.S. Cl. ..... 101/116; 101/419

[58] Field of Search ..... 101/116, 424.2, 101/424.1, 424, 416.1, 417, 418, 419

[56] References Cited

FOREIGN PATENT DOCUMENTS

| | | |
|---|---|---|
| 0 307 475 | 3/1989 | European Pat. Off. . |
| 0 373 922 | 6/1990 | European Pat. Off. . |
| 0 530 627 | 3/1993 | European Pat. Off. . |
| 0 647 531 | 4/1995 | European Pat. Off. . |

*Primary Examiner*—Edgar S. Burr
*Assistant Examiner*—Anthony H. Nguyen
*Attorney, Agent, or Firm*—Kanesaka & Takeuchi

[57] ABSTRACT

A printed image after-processing apparatus includes a rotatable contact member coated with an excess ink removing liquid incompatible with a printing ink forming a printed image on a printing sheet and having a surface tension lower than that of the printing ink; a counter member having a surface roughness of 0.5 μm or less, for feeding the printing sheet after printed between the counter member and the contact member to thereby make a printed surface of the printing sheet into contact with the contact member; a supplying device for supplying the excess ink removing liquid to the contact member; and a cleaning device contacting with the contact member.

4 Claims, 5 Drawing Sheets

FIG. 4

| | STAIN ON THE BACK SURFACE OF PRINTING SHEET |
|---|---|
| EXAMPLE 1 | ○ |
| EXAMPLE 2 | ○ |
| EXAMPLE 3 | ○ |
| COMPARISON 1 | × |
| COMPARISON 2 | × |

PRINTED IMAGE AFTER-PROCESSING APPARATUS

BACKGROUND OF THE INVENTION

The present invention relates to a printed image after-processing apparatus for use in a printing machine such as a stencil printing machine. The present invention is effective particularly for measures against set-off and strike-through in printed matter.

In printing using a liquid printing ink, various problems may sometimes occur. One of the problems is known as set-off such that when printing sheets just after printed are stacked, the printing ink forming a printed image on the lower printing sheet sticks to the back surface of the next, or upper printing sheet. Another problem is that when the printed image surface of a printing sheet just after printed is rubbed even lightly with fingers or the like, the shape of the printed image is distorted. Still another problem is known as strike-through such that the printing ink forming a printed image on a printing sheet penetrates through the printing sheet to appear on the back surface of the printing sheet.

These problems occur remarkably especially in stencil printing wherein the amount of a printing ink forming a printed image on a printing sheet, that is, the ink deposition amount on the printing sheet, is larger than that in other types of printing.

To prevent the occurrence of set-off, strike-through, etc., it is conventionally tried to reduced the ink deposition amount on the printing sheet in the course of printing. However, it is difficult to quantitatively control the ink deposition amount. If the ink deposition amount is excessively reduced, a printed image may be decreased in density or become faint, causing a reduction in quality of the printed image.

As another means of avoiding the above problems, it may be considered to heat and dry the printing ink forming the printed image. In this case, however, it is necessary to use a heater having a considerably high heating value. In such a case that the printing ink deposited on the printing sheet is dried by the drying means such as a heater, the higher the printing speed of a printing machine, the severer the conditions to be set on the drying means. Actually, it is impossible to dry the printing ink at high speeds enough to effectively prevent the occurrence of set-off, strike-through etc.

In some type of printing, the occurrence of set-off is intended to be prevented by applying fine powder such as starch or talc to a printed image surface. However, a device for applying such fine powder employs compressed air, so that a printing machine equipped with such a device is considerably large in size.

Further, in feeding a printing sheet after printed to a paper eject tray, a sorter, etc., a feed roller cannot be brought into contact with the printed image surface of the printing sheet, so as to maintain the printed image. Accordingly, the printing sheet after printed is conventionally fed by a feeding mechanism such as a belt conveyor coming into contact with only the back surface (non-printed image surface) of the printing sheet. This kind of printing sheet feeding mechanism is disclosed in Japanese Patent Laid-open No. 50-88769, for example.

However, in such a feeding mechanism that the feed roller is not in contact with the printed image surface, but in contact with only the back surface of the printing sheet in feeding the printing sheet, a paper ejection performance is deteriorated as compared with that in a copying machine such as a PPC designed to forcibly feed a copy sheet with both surfaces thereof pressed. For example, there occurs a problem such that many printed sheets of paper are not properly aligned in a feed destination such as a paper eject tray or a sorter. The tendency of such a deterioration in the paper ejection performance is more remarkable with an increase in printing speed, that is, in paper ejecting speed. Further, such a problem largely reduces a degree of freedom of setting a paper ejection path in the printing machine.

The present inventors have already proposed a novel device for removing an excess ink from a printing sheet after printed. This device includes a contact roller adapted to be rotated and an opposed roller adapted to be rotated in opposed relationship with the contact roller. An excess ink removing liquid is applied in the form of layer to the outer circumferential surface of the contact roller during rotation thereof. The printing sheet after printed is pressed between the contact roller and the opposed roller and is fed by rotation of both rollers. An excess part of a printing ink on the printed image surface of the printing sheet is transferred to the layer of the excess ink removing liquid applied to the contact roller. The excess printing ink transferred to the contact roller is removed by cleaning means such as a blade kept in contact with the contact roller.

In the case that the opposed roller is always kept in contact with the contact roller adapted to come into contact with the printed image surface, the printing sheet can be passed between the two rollers with no problem when it is present between the two rollers. However, when the printing sheet is absent between the two rollers, the excess ink removing liquid containing the excess printing ink held by the contact roller comes into contact with the opposed roller. During a time interval from the moment the printing sheet has passed between the two rollers to the moment the next printing sheet comes to a contact position between the two rollers, no printing sheet is present between the two rollers. Accordingly, during this time interval, the contact roller and the opposed roller are in direct contact with each other, so that the excess ink removing liquid containing the excess printing ink held on the contact roller is transferred to the opposed roller. Particularly in the case that the opposed roller is easily wettable with the printing ink, the printing ink transferred from the contact roller to the opposed roller is condensed on the opposed roller, and in some case, this condensed ink sticks to the back surface of the printing sheet passed between the contact roller and the opposed roller.

Suppose that the axial length of each of the contact roller and the opposed roller is equal to the B4-size (1=257 mm) and a postcard (1=100 or 148 mm) having a width smaller than the axial length is passed between the two roller. In this case, no printing sheet to be treated is present in the contact position between the two rollers except the postcard sandwiched between the two rollers, and the two rollers are in direct contact with each other. As a result, the excess ink removing liquid containing the excess printing ink held on the contact roller is transferred to the opposed roller, causing a problem such that the back surface of a printing sheet to be treated later is stained with the printing ink transferred to the opposed roller.

The present invention has been achieved to improve the above-mentioned device for removing an excess ink as proposed by the present inventors, in view of the above problems, and it is accordingly an object of the present invention to provide a printed image after-processing apparatus which can reliably avoid the occurrence of set-off and strike-through in a printing sheet after printed without inducing any other troubles, and can remove an excess printing ink on the printed image surface.

SUMMARY OF THE INVENTION

In accordance with the first aspect of the present invention, there is provided a printed image after-processing apparatus comprising a contact member adapted to be rotationally driven and coated with an excess ink removing liquid incompatible with a printing ink forming a printed image on a printing sheet and having a surface tension lower than that of the printing ink; a counter member having a surface roughness of 0.5 μm or less, for feeding the printing sheet after printed between the counter member and the contact member to thereby make a printed surface of the printing sheet into contact with the contact member; supplying means for supplying the excess ink removing liquid to the contact member; and cleaning means kept in contact with the contact member.

In accordance with the second aspect of the present invention, the printed image after-processing apparatus as defined in the first aspect is characterized in that at least an outer circumferential surface of the counter member is formed of an ink repellent material.

In accordance with the third aspect of the present invention, the printed image after-processing apparatus as defined in the second aspect is characterized in that the counter member and the contact member are always kept in contact with each other under a predetermined contact pressure.

In accordance with the fourth aspect of the present invention, the printed image after-processing apparatus as defined in the third aspect is characterized in that the contact member comprises a contact roller.

In accordance with the fifth aspect of the present invention, the printed image after-processing apparatus as defined in the third aspect is characterized in that the contact member comprises an endless belt wrapped between a plurality of roller members.

The excess ink removing liquid applied to the outer circumferential surface of the contact member comes into contact with the printed image surface of the printing sheet. An excess part of the printing ink forming the printed image on the printing sheet is transferred to the excess ink removing liquid on the contact member, thereby removing the excess printing ink from the printing sheet. The excess ink removing liquid is a liquid incompatible with the printing ink forming the printed image and having a surface tension lower than that of the printing ink. Accordingly, the excess printing ink transferred to the excess ink removing liquid is present on the surface of the liquid in a floating condition such that the excess printing ink is physically separate from the excess ink removing liquid. The excess printing ink in such a floating condition is removed by the cleaning means kept in contact with the contact member. That is, in association with rotation of the contact member, the excess printing ink floating from the surface of the contact member is removed from the contact member by the cleaning means kept in contact with the surface of the contact member.

In such a structure that a contact roller as the contact member and an opposed roller as the counter member are always kept in contact with each other, when the printing sheet is absent between the contact roller and the opposed roller, the excess ink removing liquid containing the excess printing ink on the contact roller comes into contact with the opposed roller. However, since the opposed roller has a surface roughness of 0.5 μm or less and is formed of a material having an ink repellent property to the printing ink, the excess ink contained in the excess ink removing liquid having come into contact with the opposed roller does not stick to the opposed roller, but remains attached to the contact roller and is fed by the rotation of the opposed roller. That is, the opposed roller is not stained with the excess ink. Accordingly, even when the printing sheet is passed between the contact roller and the opposed roller, the back surface (non-printed image surface) of the printing sheet is not stained with the excess ink.

BRIEF DESCRIPTION OF THE DRAWINGS

FIG. 4 is a table showing the results of evaluation of performances in Examples according to the present invention and Comparisons as determined according to the presence or absence of stain on the back surface of a printing sheet.

DETAILED DESCRIPTION OF THE PREFERRED EMBODIMENTS

Figure 1:
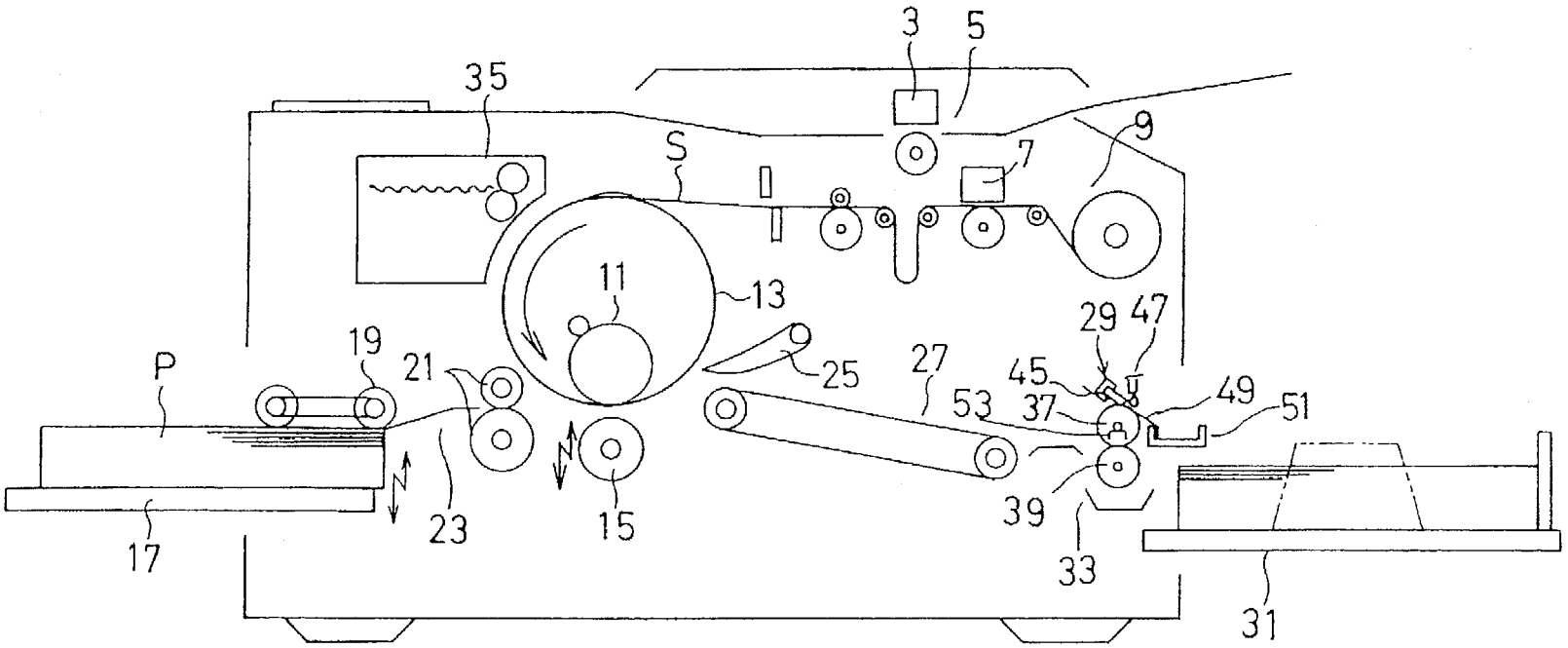
FIG. 1 is a side view illustrating the configuration of a preferred embodiment of the present invention.

The structure of a stencil printing machine according to a first preferred embodiment of the present invention will now be described with reference to FIGS. 1 and 2. An original image reading section 5 has an image scanner 3 to read an image on an original as a subject to be printed. A perforating section 9 has a perforating device 7 to form a perforation image on a stencil sheet S according to original image data read by the original reading section 5.

The stencil sheet S perforated by the perforating section 9 is wrapped around the outer circumferential surface of a cylindrical print drum 13. An ink supply device 11 including an ink squeegee device is provided inside the print drum 13 to supply ink to the inner circumferential surface of the print drum 13. A vertically movable, press roller 15 is located below the print drum 13. The press roller 15 serves to nip and feed a printing sheet P supplied between the print drum 13 and the press roller 15, thereby forming an image on the printing sheet P.

In a paper feeding section 23, a plurality of printing sheets P stacked on a paper feed tray 17 are fed one by one by a sheet separation/feed roller 19, and are further fed to between the press roller 15 and the print drum 13 by a pair of paper feed timing rollers 21.

In a paper ejecting section 33, the printing sheet P after printed is separated from the print drum 13 by a separation claw 25. The printing sheet P separated is then fed to a printed image after-processing apparatus 29 by a feeding device 27 with a belt conveyor mechanism. The printed image after-processing apparatus 29 performs a process of removing an excess ink from the printed image formed on the printing sheet P. The printing sheet P after subjected to this process is ejected onto a paper eject tray 31 for receiving a plurality of printed sheets in a stacked manner.

The stencil sheet S after completing the printing operation is separated from the print drum 13 by a stencil sheet ejecting section 35, and the stencil sheet S thus separated is abandoned.

The printing operation in the above stencil printing machine will now be described. The print drum 13 is driven by driving means (not shown) to rotate counterclockwise as viewed in FIG. 1 about its center axis. At a given timing synchronized with rotation of the print drum 13, the printing sheet P is fed from the left to the right as viewed in FIG. 1 by the paper feed timing rollers 21 to reach a position between the print drum 13 and the press roller 15. The printing sheet P fed to this position is pressed by the press roller 15 onto the stencil sheet S wrapped around the outer circumferential surface of the print drum 13, thus performing stencil printing.

The printing sheet P after printed is separated from the print drum 13 by the separation claw 25, and is then fed to the printed image after-processing apparatus 29 by the feeding device 27 in such a manner that a printed image has been formed on the upper surface of the printing sheet P. The printing sheet P thus having the printed image is subjected to the process to be performed by the printed image after-processing apparatus 29, and is fed to the paper eject tray 31. This printing operation is repeatedly carried out, so that a plurality of printing sheets P after printed are stacked one by one on the paper eject tray 31.

Now, the configuration and the operation of the printed image after-processing apparatus 29 will be described. As shown in FIG. 2, the printed image after-processing apparatus 29 includes a contact roller 37 as the contact member coming into contact with the printed image surface (the upper surface) of the printing sheet P after printed and an opposed roller 39 as the counter member located in opposed relationship with the contact roller 37. The contact roller 37 and the opposed roller 39 are rotatably supported in parallel relationship with each other by shafts 41 and 43, respectively. The opposed roller 39 is biased upward as viewed in FIG. 2, i.e., toward the contact roller 37 by means of a spring as biasing means (not shown). When the printing sheet P is absent between the contact roller 37 and the opposed roller 39, the two rollers 37 and 39 are in contact with each other.

A blade 45 as a plate-like member having a substantially rectangular cross section is in contact with an outer circumferential surface 37*a* (excess ink removing liquid applied surface) of the contact roller 37. The blade 45 is fixed at its base end portion to the front end of a sheet metal member, and the front end of the blade 45 is in contact with the contact roller 37. The blade 45 is located above the top of the contact roller 37 to be inclined down toward the contact roller 37. The lower corner edge of the front end of the blade 45 is in contact with the outer circumferential surface 37*a* of the contact roller 37 at a position upstream of the top of the contact roller 37 in respect of the rotational direction of the contact roller 37.

An excess ink removing liquid supply nozzle 47 is located above the outer circumferential surface 37*a* of the contact roller 37 at a position upstream of the contact position between the blade 45 and the contact roller 37 in respect of the rotational direction of the contact roller 37. The excess ink removing liquid supply nozzle 47 constitutes the supplying means for supplying an excess ink removing liquid onto the outer circumferential surface 37*a* of the contact roller 37. The excess ink removing liquid is a liquid incompatible with the printing ink forming the printed image and having a surface tension smaller than that of the printing ink.

Figure 2:
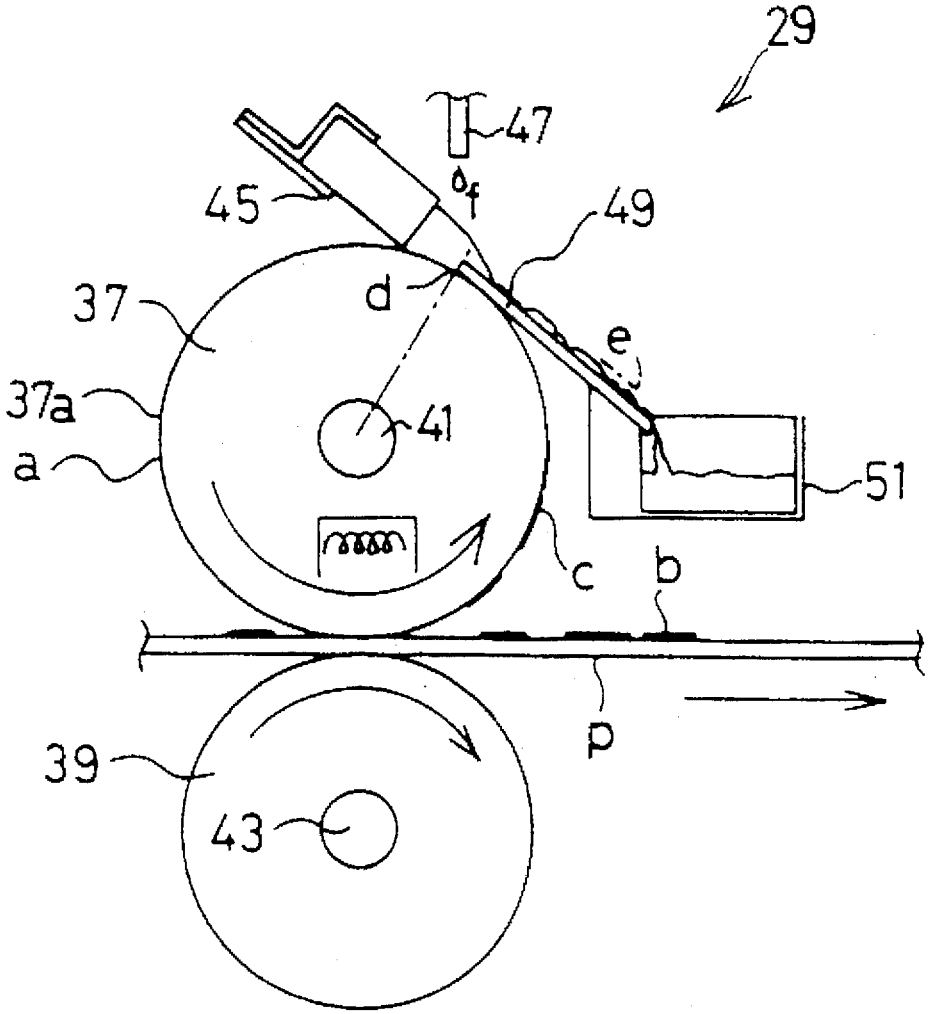
FIG. 2 is an enlarged side view of a printed image after-processing apparatus shown in FIG. 1.

When the excess ink removing liquid is supplied from the excess ink removing liquid supply nozzle 47 onto the outer circumferential surface 37*a* of the contact roller 37, the excess ink removing liquid gathers between the blade 45 and the contact roller 37 as shown in FIG. 2. In association with rotation of the contact roller 37, the excess ink removing liquid thus gathering is passed between the contact roller 37 and the blade 45 to form a layer on the outer circumferential surface 37*a* of the contact roller 37. At this time, the blade 45 functions to uniform the thickness of the layer of the excess ink removing liquid to be formed on the outer circumferential surface 37*a* of the contact roller 37. The blade 45 functions also as cleaning means for removing dirt on the outer circumferential surface 37*a* of the contact roller 37.

The opposed roller 39 is located opposite to the contact roller 37 now having the layer of the excess ink removing liquid on the outer circumferential surface 37*a*. In this preferred embodiment, at least the outer circumferential surface of the opposed roller 39 has a surface roughness 39*a* of 0.5 μm or less. Accordingly, even when the excess ink removing liquid containing excess printing ink on the outer circumferential surface 37*a* of the contact roller 37 comes to the contact position between the contact roller 37 and the opposed roller 39, the excess printing ink does not stick to the outer circumferential surface of the opposed roller 39, but continues to be held on the outer circumferential surface 37*a* of the contact roller 37. Thus, the opposed roller 39 is not stained with the excess ink, so that even when the printing sheet P is passed between the contact roller 37 and the opposed roller 39, the back surface (non-printed image surface) of the printing sheet P is not stained with the excess ink.

A surface roughness Ra is defined by JIS (Japanese Industrial Standards) B0601. When a surface to be measured is cut along a plane perpendicular to this surface, the outline of the cross section appearing is called a profile curve. The remainder obtained by cutting off waviness components having wavelengths larger than a given wavelength from the profile curve is called a roughness curve. By sampling a part with a measurement length l from the roughness curve along its center line and representing the roughness curve as y=f(x) where the x-axis represents the center line of the sampled part and the y-axis represents the direction of longitudinal magnification, the surface roughness Ra is given by the following expression where the unit of measurement is micrometer.

$$Ra = (1/l)\int_0^l |f(x)|dx$$

As will be apparent from the comparison between Examples and Comparisons to be hereinafter described, if the surface roughness is larger than 0.5 μm, the excess ink removing liquid containing the excess ink on the outer circumferential surface 37*a* of the contact roller 37 always kept in contact with the opposed surface 39 is transferred to the outer circumferential surface of the opposed roller 39, so that the excess ink removing liquid containing the excess ink stays in pits of the outer circumferential surface of the opposed roller 39. As a result, when the printing sheet P is passed between the contact roller 37 and the opposed roller 39, the back surface (non-printed image surface) of the printing sheet P is stained with the excess printing ink sticking to the opposed roller 39.

Further, in this preferred embodiment, at least the outer circumferential surface of the opposed roller 39 is formed of a material having an ink repellent property, thereby further suppressing the transfer of the excess ink removing liquid containing the excess ink from the outer circumferential surface 37*a* of the contact roller 37 to the outer circumferential surface of the opposed roller 39.

A sheetlike elastic member 49 as means for recovering the excess ink removing liquid is located at a position upstream of the blade 45 in respect of the rotational direction of the contact roller 37. The sheetlike elastic member 49 is a thin sheet having a given elasticity. The sheetlike elastic member 49 has a front end portion kept in contact with the outer circumferential surface 37*a* of the contact roller 37 at a position d upstream of the contact position between the blade 45 and the contact roller 37 in respect of the rotational direction of the contact roller 37. Further, the sheetlike elastic member 49 is located as a whole inside of a tangent e of the contact roller 37 at the position d, that is, located on the side of the contact roller 37 with respect to the tangent e. Further, the sheetlike elastic member 49 is inclined so that the rear end portion thereof is lower in level than the front end portion. Accordingly, the front end portion and its near portion of the sheetlike elastic member 49 are in close contact with the outer circumferential surface 37*a* of the contact roller 37 in a given range of length. In other words, the front end portion and its near portion of the sheetlike elastic member 49 are elastically deformed to follow the shape of the outer circumferential surface 37*a* of the contact roller 37.

The rear end portion of the sheetlike elastic member 49 is fixed to a liquid recovery member 51 for recovering the excess ink removing liquid. The liquid recovery member 51 is located at a level lower than the position d. The front end portion of the sheetlike elastic member 49 is a free end, which is in contact with the contact roller 37 as mentioned above. In this manner, the sheetlike elastic member 49 is inclined so that the front end portion as the free end is in contact with the contact roller 37, and the rear end portion fixed to the liquid recovery member 51 is lower in level than the front end portion.

As mentioned above, the excess ink removing liquid used in this preferred embodiment is a liquid incompatible with the printing ink forming the printed image on the printed image surface of the printing sheet P and having a surface tension lower than that of the printing ink. Examples of the liquid satisfying these conditions include dimethyl silicone oil, phenyl-, polyether-, fluorine-, amino-, epoxy-, carboxyl-, carbinol-, methacryl-, mercapto-, or phenol-modified silicone oil, and an aqueous solution containing a surface active agent or an organic solvent.

The surface active agent to be added to water includes anionic, cationic, and amphoteric surface active agents and a nonionic surface active agent. The amount of the surface active agent to be added is decided so that the surface tension of the excess ink removing liquid becomes lower than that of the printing ink.

The organic solvent to be added to water is an organic solvent compatible with water. Examples of such an organic solvent include methanol, ethanol, isopropyl alcohol, n-propyl alcohol, ethylene glycol, and glycerol.

Further, the excess ink removing liquid is uniformly applied to the outer circumferential surface 37*a* of the contact roller 37. The thickness of the layer of the excess ink removing liquid to be applied is set to preferably about 0.0001 to 1 μm. This thickness range corresponds to about 0.1 to 100 mg/B4-size sheet in terms of an amount of the excess ink removing liquid to be applied to the printing sheet.

The contact roller 37, the opposed roller 39, and the blade 45 are formed of a material not to be changed in quality, e.g., not be swelled, by the excess ink removing liquid. For example, when the main component of the excess ink removing liquid is silicone oil, the contact roller 37, the opposed roller 39, and the blade 45 are preferably formed of fluororesin (fluororubber), phenyl-modified silicone resin (rubber), or urethane rubber.

Now, the operation of the printed image after-processing apparatus 29 configured above will be described. The printing sheet P after printed is fed under pressure between the contact roller 37 and the opposed roller 39. An excess ink removing liquid film a formed on the outer circumferential surface 37*a* of the contact roller 37 comes into contact with the printed image surface of the printing sheet P in association with rotation of the contact roller 37. During the contact of the film a and the printed image surface, an excess part of a printing ink b forming the printed image on the printing sheet P is transferred to the film a on the contact roller 37, thus removing the excess printing ink from the printing sheet P.

The excess printing ink (denoted by a reference character c) transferred to the film a on the contact roller 37 is then passed through the contact portion between the sheetlike elastic member 49 and the contact roller 37 by the rotation of the contact roller 37.

The excess ink removing liquid used in this preferred embodiment is a liquid incompatible with the printing ink b forming the printed image and having a surface tension lower than that of the printing ink c. Accordingly, when the film a on the contact roller 37 onto which the excess printing ink c has been transferred is scraped off by the blade 45, an excess ink removing liquid gathering portion f containing the printing ink c in a dispersed condition is generated on the just upstream side of the blade 45 in respect of the rotational direction of the contact roller 37.

On the outer circumferential surface 37*a* of the contact roller 37 having passed the blade 45, the film a now not containing the printing ink c is regenerated. Then, the film a thus regenerated on the contact roller 37 comes again into contact with the printed image surface of the printing sheet P in association with rotation of the contact roller 37. Accordingly, the printed image surface of the printing sheet P is not stained with the printing ink c transferred to the contact roller 37.

The contact position between the blade 45 and the outer circumferential surface 37*a* of the contact roller 37 is located upstream of the top of the contact roller 37 in respect of the rotational direction of the contact roller 37. Therefore, when the amount of the excess ink removing liquid gathering portion f exceeds a certain limit, the excess ink removing liquid of the gathering portion f starts flowing by its own weight in a direction opposite to the rotational direction of the contact roller 37 in spite of the rotation of the contact roller 37. This flow of the excess ink removing liquid is guided by the inclined upper surface of the sheetlike elastic member 49 to drop into the liquid recovery member 51, thus recovering the excess ink removing liquid used.

In this manner, by passing the printing sheet P after printed between the contact roller 37 and the opposed roller 39, the excess part of the printing ink b forming the printed image on the printing sheet P can be reliably removed by the excess ink removing liquid film a formed on the outer circumferential surface 37*a* of the contact roller 37. Accordingly, the occurrence of set-off and strike-through in the printing sheet P after printed can be suppressed. Furthermore, even when the printed image surface is rubbed with fingers or the like just after ejecting the printing sheet P, the shape of the printed image can be almost kept. In addition, the printing ink b forming the printed image can be quickly dried.

According to this preferred embodiment, the opposed roller 39 comes into contact with the contact roller 37 with a given force in order to make reliable contact of the printed image on the printing sheet P and the excess ink removing liquid film a on the contact roller 37. With such a structure, when the printing sheet P is absent between the contact roller 37 and the opposed roller 39, the two rollers 37 and 39 come into direct contact with each other. In the case where the excess ink is not completely scraped off by the blade 45 at this time, the excess ink removing liquid containing the excess ink on the contact roller 37 comes into contact with the opposed roller 39.

However, since the opposed roller 39 is formed of a material having an ink repellent property to the printing ink and has a surface roughness of 0.5 μm or less, the excess printing ink contained in the excess ink removing liquid having come into contact with the opposed roller 39 does not stick to the opposed roller 39, but remains attached to the contact roller 37 and is fed therewith by the rotation of the opposed roller 39. That is, the opposed roller 39 is not stained with the printing ink. Accordingly, even when the printing sheet P is passed between the contact roller 37 and the opposed roller 39, the back surface (non-printed image surface) of the printing sheet P is not stained with the printing ink.

There will now be described Examples 1 to 3 as more specific examples of the above preferred embodiment and Comparisons 1 and 2.

(Example 1)

The device shown in FIG. 2 according to the above preferred embodiment was set in a stencil printing machine [Risograph (registered tradename) RA205 manufactured by Riso Kagaku Corporation]. The contact roller was prepared by baking P.T.F.E. (polytetrafluoroethylene) on the surface of an aluminum roller and thereafter polishing the baked surface of the roller. The opposed roller was prepared by covering a silicone rubber roller (having a hardness of 30°) with a heat shrinkable tube of P.F.A. (polytetrafluoroethylene-perfluoroalkylvinyl ether) and thereafter treating the surface of the roller at a temperature of 130° to 150° C. The surface roughness (Ra) of the opposed roller was set to 0.10 μm.

The hardness of silicone rubber is defined by JIS (Japanese Industrial Standards) K6301. The measurement is made by using an A-type or C-type spring hardness testing machine shown in this standard. This testing machine is designed so that when its pressure surface is brought into contact with the surface of a test piece of rubber as the subject to be tested, a pusher needle projected from a hole formed at the center of the pressure surface by a spring pressure is retracted by the test piece, in which the distance of retraction of the pusher needle is expressed in a scale as the hardness.

As the excess ink removing liquid, dimethyl silicone oil [KF-96 manufactured by Shin-Etsu Chemical Co., Ltd., having a viscosity of 100 (cps)] was used, and the setting condition of the blade 45 was adjusted so that the amount of the excess ink removing liquid to be applied to a B4-size printing sheet was 1 (mg).

(Example 2)

A device similar to that in Example 1 was used. A contact roller similar to that in Example 1 was used. An opposed roller similar to that in Example 1 was used, but the surface roughness of the opposed roller was set to 0.50 μm. The other conditions were the same as those in Example 1.

(Example 3)

A device similar to that in Example 1 was used. The opposed roller used in Example 1 was used as a contact roller, and the contact roller used in Example 1 was used as an opposed roller. The center line surface roughness of the opposed roller was set to 0.25 μm. The other conditions were the same as those in Example 1.

(Comparison 1)

A device similar to that in Example 1 was used. A contact roller similar to that in Example 1 was used. An opposed roller similar to that in Example 1 was used, but the surface roughness of the opposed roller was set to 0.60 μm. The other conditions were the same as those in Example 1.

(Comparison 2)

A device similar to that in Example 1 was used. A contact roller similar to that in Example 1 was used. An opposed roller formed of chloroprene rubber (CR) having no ink repellent property was used. The surface roughness of the opposed roller was set to 0.55 μm. The other conditions were the same as those in Example 1.

The performances in Examples 1 to 3 and Comparisons 1 and 2were evaluated according to the presence or absence of stain on the back surface of the printing sheet after printed. The results of this evaluation are shown in Table 1. The measurement of the surface roughness was made by using Surfcoder SE-30K manufactured by Kosaka Laboratory Ltd. The conditions of this measurement were a measurement length of 2 mm, a cutoff length of 0.8 mm, and a driving speed of 0.05 mm/sec.

The stain on the back surface of the printing sheet was determined as ○ and X in accordance with the following criteria.

○: A white sheet of paper was used as the printing sheet, and any stain due to the printing ink was not generated on the back surface of the white sheet of paper (the contact surface to the opposed roller).

X: A white sheet of paper was used as the printing sheet, and a stain due to the printing ink (black) was generated on the back surface of the white sheet of paper (the contact surface of the opposed roller).

TABLE 1

| Stain on the back surface of printing sheet | |
|---|---|
| Example 1 | ○ |
| Example 2 | ○ |
| Example 3 | ○ |
| Comparison 1 | X |
| Comparison 2 | X |

Figure 3:
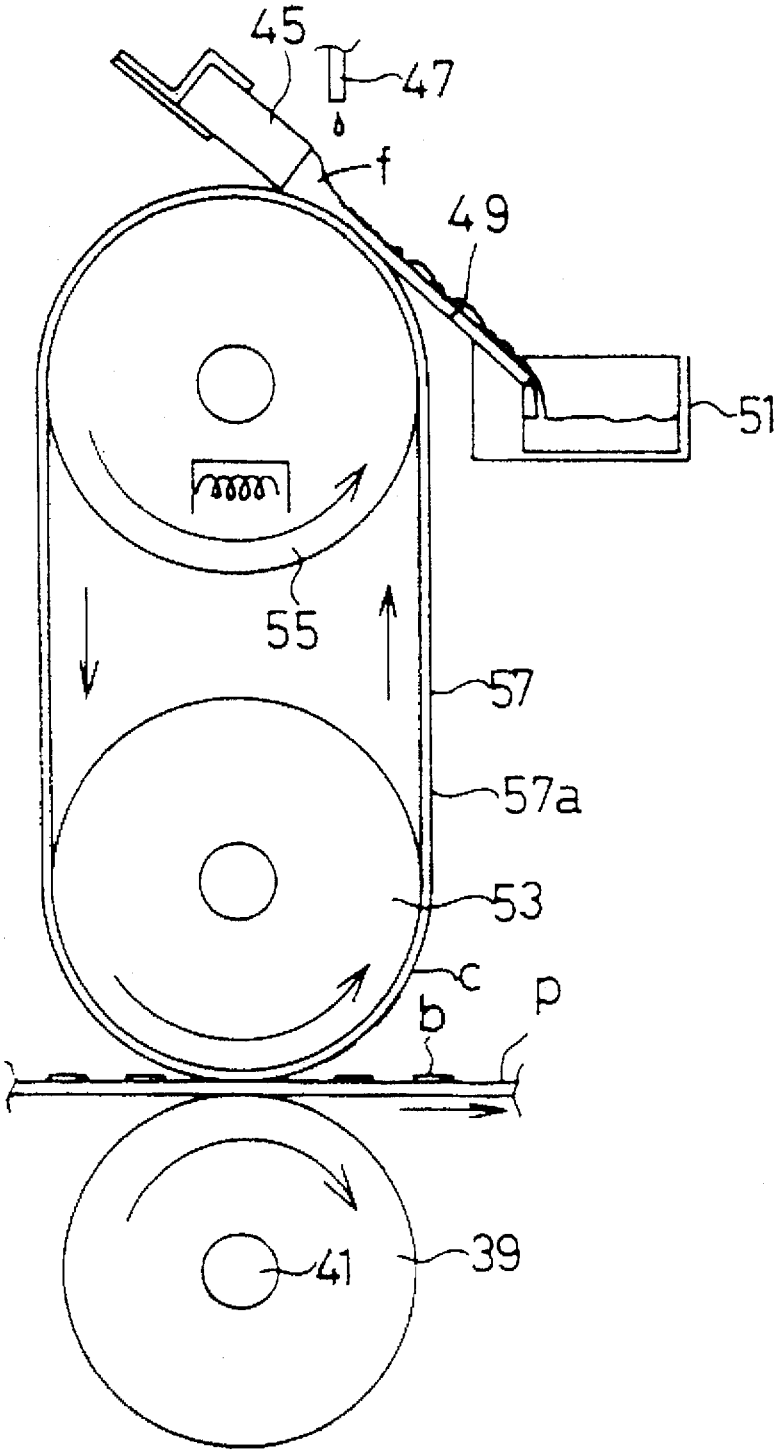
FIG. 3 is an enlarged side view of another preferred embodiment of the printed image after-processing apparatus according to the present invention.
Figure 5:
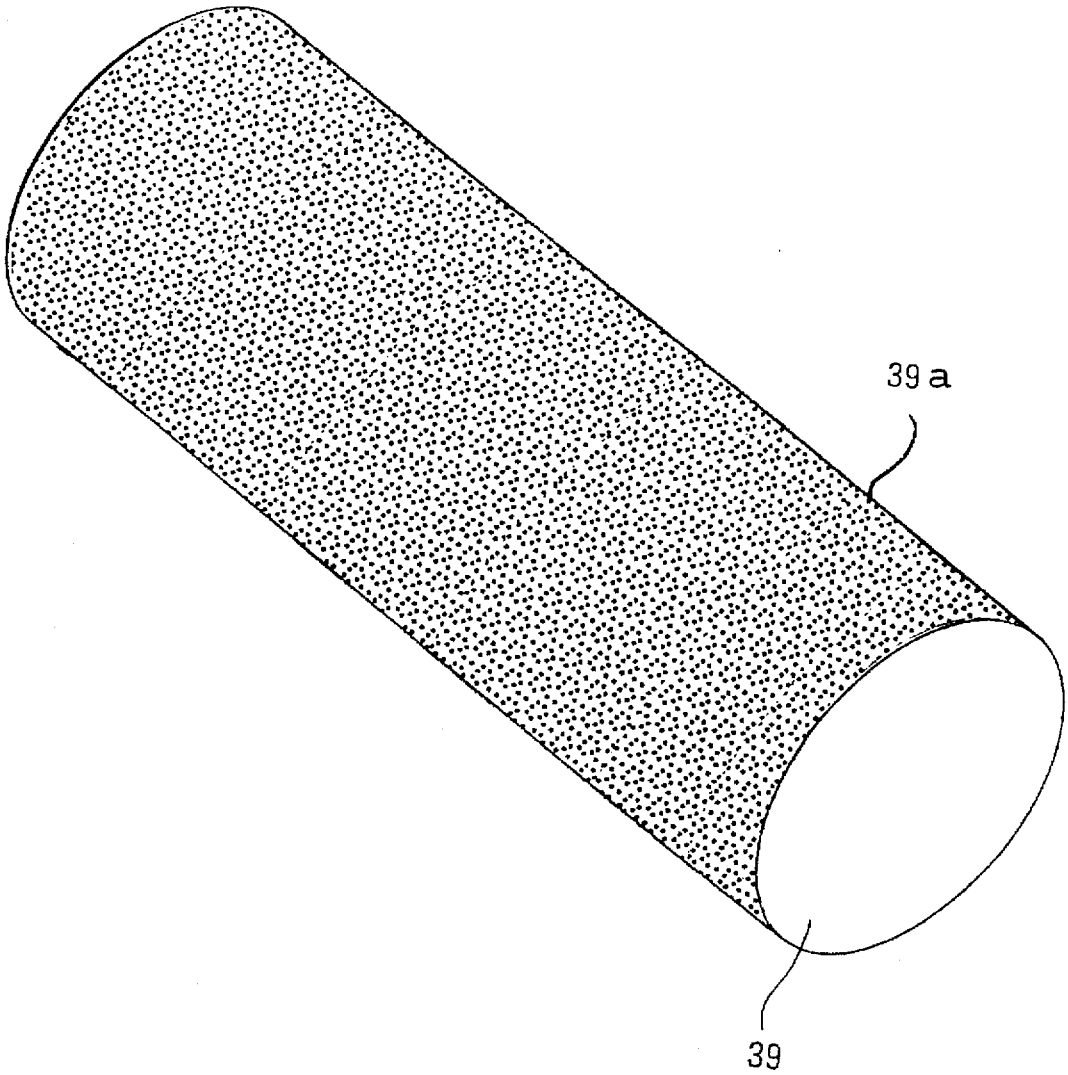
FIG. 5 is an enlarged perspective view for showing a part of an opposed roller.

Another preferred embodiment of the present invention will now be described with reference to FIG. 3. In FIG. 3, parts corresponding to those shown in FIG. 2 are denoted by the same reference numerals, and the description thereof will be hereinafter omitted. In this preferred embodiment, a flexible endless belt 57 as the contact member is wrapped under a given tension between two rollers 53 and 55 vertically spaced from each other. Also according to this preferred embodiment, effects substantially similar to those of the previous preferred embodiment can be obtained.

According to the present invention, the printing sheet is pressed by the counter member against the contact member, and the printed image surface of the printing sheet is brought into contact with the excess ink removing liquid attached to the surface of the contact member. This contact allows complete removal of an excess part of the printing ink forming the printed image on the printing sheet. Accordingly, the occurrence of set-off and strike-through in the printing sheet after printed can be reliably avoided without inducing any other troubles. Furthermore, even when the printed image surface is rubbed with fingers or the like just after printing, the shape of the printed image can be almost kept.

The excess ink removing liquid is a liquid incompatible with the printing ink forming the printed image and having a surface tension lower than that of the printing ink. Accordingly, the excess printing ink transferred to the excess ink removing liquid layer on the contact member is present on the surface of the layer in a floating condition such that the excess printing ink is physically separate from the excess ink removing liquid. As a result, the printed image surface of the printing sheet is not stained with the liquid.

In the case where the printing sheet is absent between the contact member and the counter member, the contact member and the counter member are in direct contact with each other, so that the excess ink removing liquid containing the excess printing ink on the contact member comes into contact with the counter member. However, since the counter member is formed of a material having a surface roughness of 0.5 μm or less and having an ink repellent property to the printing ink, the excess printing ink contained in the excess ink removing liquid having come into contact with the counter member does not stick to the counter member, but remains attached to the contact member. That is, the counter member is not stained with the printing ink. Accordingly, even when the printing sheet is passed between the contact member and the counter member, the back surface (non-printed image surface) of the printing sheet is not stained with the printing ink.

What is claimed is:

1. A printed image after-processing apparatus comprising, supplying means for supplying an excess ink removing liquid, said excess ink removing liquid being incompatible with a printing ink forming a printed image on a printing sheet and having a surface tension lower than that of said printing ink;

a rotating contact member coated with the excess ink removing liquid supplied from the supplying means;

a counter member situated adjacent to the rotating contact member and having a surface roughness of 0.5 μm or less, said counter member feeding said printing sheet after being printed between said counter member and said rotating contact member to thereby bring a printed surface of said printing sheet into contact with said rotating contact member; and cleaning means contacting said rotating contact member for cleaning the same.

2. A printed image after-processing apparatus according to claim 1, wherein said counter member has an outer surface formed of an ink repellent material.

3. A printed image after-processing apparatus according to claim 2, wherein said rotating contact member comprises a contact roller.

4. A printed image after-processing apparatus according to claim 2, wherein said rotating contact member comprises an endless belt and a plurality of roller members for wrapping the endless belt.

* * * * *